US006987439B2

(12) United States Patent
Cattaneo

(10) Patent No.: US 6,987,439 B2
(45) **Date of Patent: *Jan. 17, 2006**

(54) MAGNETIC CIRCUIT WITH COIL

(75) Inventor: Frédéric Cattaneo, Monnetier Mornex (FR)

(73) Assignee: Liaisons Electroniques-Mecaniques LEM SA, Plan-les-Ouates (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/630,463

(22) Filed: Jul. 30, 2003

(65) Prior Publication Data

US 2004/0021540 A1 Feb. 5, 2004

Related U.S. Application Data

(62) Division of application No. 09/525,999, filed on Mar. 15, 2000, now Pat. No. 6,640,419.

(30) Foreign Application Priority Data

Jun. 4, 1999 (CH) ..... 1056/99

(51) Int. Cl.
*H01F 27/28* (2006.01)

(52) U.S. Cl. ..... 336/229

(58) Field of Classification Search ..... 336/174, 336/229, 210, 84, 178; 29/602.1
See application file for complete search history.

(56) References Cited

U.S. PATENT DOCUMENTS

| | | | | |
|---|---|---|---|---|
| 1,994,534 | A | 3/1935 | Robinson | |
| 4,408,639 | A * | 10/1983 | Hayama et al. | 140/71.5 |
| 4,616,682 | A | 10/1986 | Groenewegen | |
| 5,103,163 | A | 4/1992 | McLyman | |
| 5,172,052 | A | 12/1992 | Wells | |
| 5,583,475 | A * | 12/1996 | Raholijaona et al. | 336/229 |
| 6,232,863 | B1 * | 5/2001 | Skinner et al. | 336/96 |
| 6,480,088 | B2 * | 11/2002 | Okamoto | 336/229 |
| 6,762,666 | B2 * | 7/2004 | Chu | 336/229 |

FOREIGN PATENT DOCUMENTS

| | | |
|---|---|---|
| EP | 133695 | 3/1985 |
| EP | 194225 | 9/1986 |
| EP | 392439 | 10/1990 |
| EP | 688596 | 4/1997 |
| EP | 692098 | 5/1997 |
| JP | 57120314 | 7/1982 |
| JP | 59147415 | 8/1984 |
| JP | 60152012 | 8/1985 |
| WO | WO8704559 | 7/1987 |
| WO | WO9314509 | 7/1993 |

* cited by examiner

*Primary Examiner*—Tuyen T Nguyen
(74) *Attorney, Agent, or Firm*—Clifford W. Browning; Woodard, Emhardt, Moriarty, McNett & Henry LLP

(57) ABSTRACT

A magnetic circuit (1) with coil having an electric coil (2) and a magnetic core (3), the coil (2) comprising a conducting wire (6) and an end plate (4) and connector (5) being arranged at respective ends of the coil (2). The coil is mounted on the magnetic core (3) which is formed of a tore-shaped magnetic wire.

9 Claims, 5 Drawing Sheets

MAGNETIC CIRCUIT WITH COIL

This is a division of application Ser. No. 09/525,999, filed Mar. 15, 2000, now U.S. Pat. No. 6,640,419.

BACKGROUND OF THE INVENTION

The present invention relates to a magnetic circuit with a coil, and a method of making such a circuit.

Magnetic circuits with coils are used in many fields including those relating to current sensors and transformers. In applications such as current sensors, measurement precision is closely related to the magnetic properties of the materials used and to the manufacturing precision. Attaining a specified precision is often in conflict with the need to reduce manufacturing costs and the size of components.

A method of manufacturing a coil on a tore-shaped magnetic circuit is described in European patent EP 668 596. The method described in this patent, which attempts to respond to the above mentioned criteria, comprises the steps of winding a conducting wire coated with a thermo-adhesive around a cylindrical mandrel to form a coil, opening a magnetic circuit by separating ends thereof forming the air-gap, sliding the coil onto the magnetic circuit and subsequently closing the magnetic circuit.

This conventional method has a number of disadvantages. Firstly, it is very difficult to remove the coil from the cylindrical mandrel and thereafter insert it on the core. Secondly, opening and closing the magnetic circuit, as in any plastic deformation, deteriorates the magnetic properties of the circuit.

BRIEF SUMMARY OF THE INVENTION

In view of the above disadvantages, the object of the present invention is to provide a magnetic circuit with coil having a precise electrical and magnetic behaviour and which may be manufactured industrially in a economic manner.

Objects of the invention have been achieved providing a magnetic circuit with coil as described.

In the present invention, a method of making a magnetic circuit with coil having an electrical coil and a magnetic core comprises the steps of making a coil by winding a conducting wire on a mandrel having a slightly conical exterior surface, and inserting the coil on a magnetic core in the form of an open spire, said spire being formed before providing the magnetic material thereof with its specific magnetic properties. After insertion of the coil on the magnetic core, ends of the core are deformed in a direction substantially orthogonal to the plane of the magnetic circuit to bring them closer together. Advantageously, through this method, the magnetic material is deformed minimally in order to avoid degrading its magnetic properties.

The coil may be inserted on the magnetic core during its removal from the mandrel, which reduces the time and cost of manufacturing the magnetic circuit with coil. In this respect, it is advantageous to insert an end of the magnetic core in a cavity at an end of the mandrel to facilitate insertion of the coil on the magnetic core.

The magnetic circuit with coil may further comprise an end plate and a connector, the end plate and the connector each arranged at a respective end of the coil, the coil being mounted on the magnetic core formed of a tore-shaped magnetic wire. The end plate facilitates insertion of the coil on the core by virtue of its shape and dimensions and by reducing the coefficient of friction.

To this end, the end plate may advantageously have a chamfered inner surface to facilitate following the curvature of the core. The end plate also protects the electrical wire from damage to its insulation layer by rubbing against the tore.

The mandrel of the device for making the magnetic circuit with coil, around which the coil is formed, may comprise a slightly conical exterior surface. This facilitates removal of the coil from the mandrel.

The angle $\alpha$ of the cone may be very small, for example having a value tan $\alpha$ situated between 0.001 and 0.01. The difference in diameter of the coil between ends thereof is therefore negligible.

The mandrel may further comprise a cavity at its free end to enable insertion of an end of the magnetic core therein, thereby facilitating assembly of these components.

Other objects and advantageous features of the invention will be apparent from the description and claims hereafter, and from the annexed drawings.

DETAILED DESCRIPTION OF THE INVENTION

Figure 1:
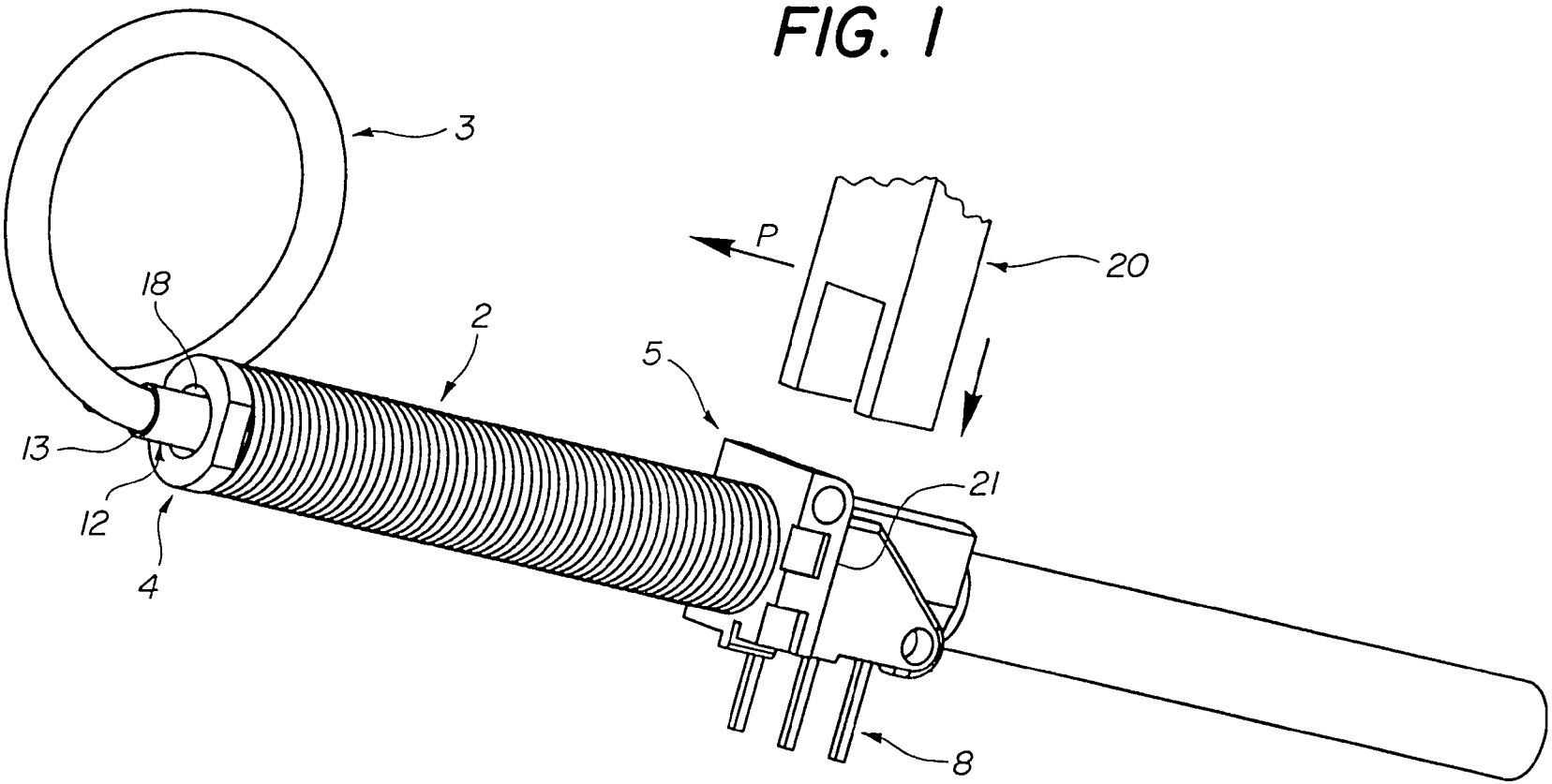
FIG. 1 is a perspective view of a mandrel and a coil formed on the mandrel ready for insertion on a magnetic core, according to the invention.

A magnetic circuit 1 with coil comprises a coil 2 and a magnetic core 3. The coil 2 comprises an end plate 4 at an insertion end 19, a connector 5 at the other end 10 and a conducting wire 6 wound around a central cavity 7 and extending between the connector 5 and the end plate 4. The conducting wire 6 may, for example, be made of conventional copper wire provided with an adhesive insulting layer to form the coil. The wire may also be a simple insulated wire, the adhesive being applied during formation of the coil.

The connector 5 comprises terminals 8 for connecting the magnetic circuit with coil to an electronic or other device. The terminals 8 are received in a housing 9 of the connector which also serves as a support for an end 10 of the coil and of the ends of conducting wires of the coil electrically connected to the terminals 8. Connection of the conducting wires to an external device is thus facilitated by integrating the connector 5 to the coil during manufacture thereof, whilst protecting and ensuring a good connection between the conducting wires of the coil and the electronic device.

The end plate 4 at the other end of the coil 2 serves as a support for the insertion end of the coil and provides an interior guiding surface 11 to protect the conducting wire from wear during insertion of the core 3 which may result in short circuits between spires. Moreover, guiding of the insertion end 19 of the coil by the end plate 4 during deformation of the coil as it is inserted on the tore-shaped core is significantly improved. The end plate 4 enables provision of a guide surface 11 with well-defined shape and dimensions and a reduced coefficient of friction between the coil and magnetic core 3. In particular, the end plate comprises a chamfer 18 to follow the curvature of the magnetic core 3.

Figure 5:
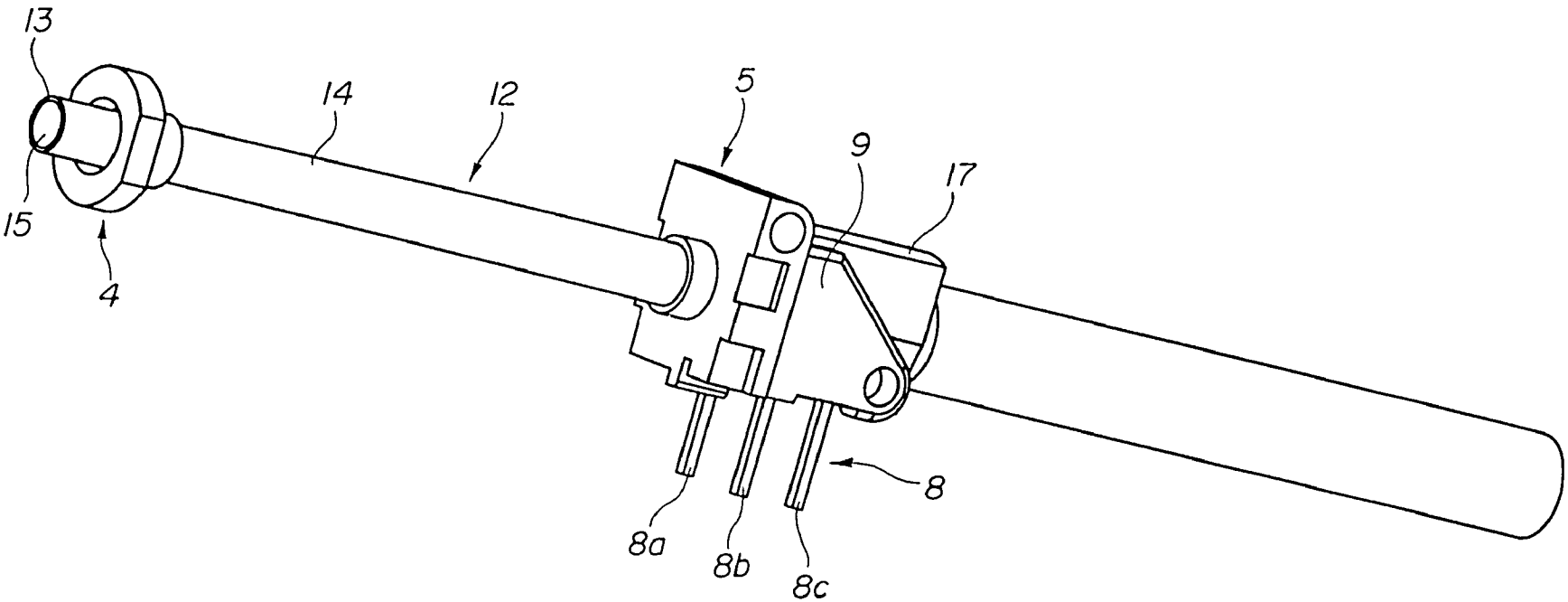
FIGS. 5 to 7 are respective views showing different steps in the manufacture of the coil.
Figure 6:
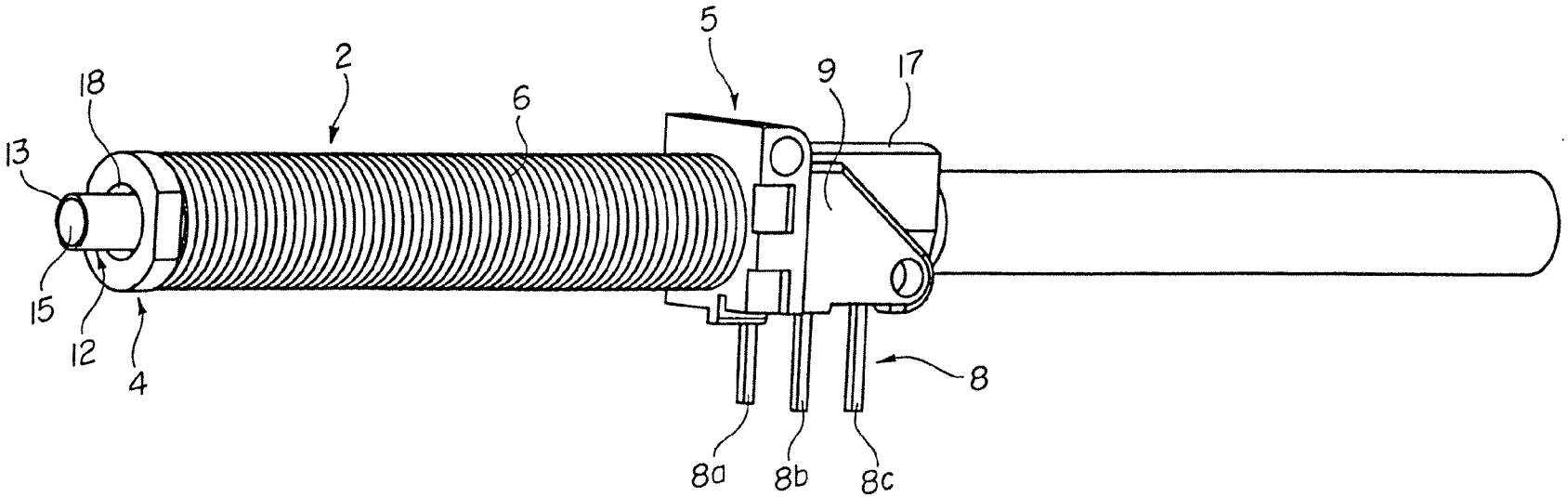

After insertion of the connector 8 and the end plate 4 on a mandrel 12, as shown in FIG. 5, an end of the conducting wire is connected to a terminal 8*a* of the connector and the coil 2 is subsequently wound around the mandrel 12 as shown in FIG. 6. At the end of the winding operation, the other end of the conducting wire is connected to a terminal 8*b*. Connection between the wire and terminals 8*a*, 8*b*, may be effected by a wire wrap connection or by other conventional means. The coil may comprise one or more supplementary windings connected to one or more supplementary terminals, such as indicated by the reference number 8*c*.

The mandrel 12 extends along an axis of rotation A to a free end 13. The mandrel has a slightly conical exterior surface 14 to facilitate removal of the coil therefrom and insertion thereof on the magnetic core 3. The angle $\alpha$ of the cone may be very small, for example tan $\alpha$ may have a value lying between 0.001 and 0.01, such that the influence of the cone on the change in diameter of the coil is negligible while maintaining the advantage of easy removal of the coil from the mandrel. It should be noted that this advantage is all the more important if the wires are coated with an adhesive product for maintaining the shape of the coil.

Figure 2:
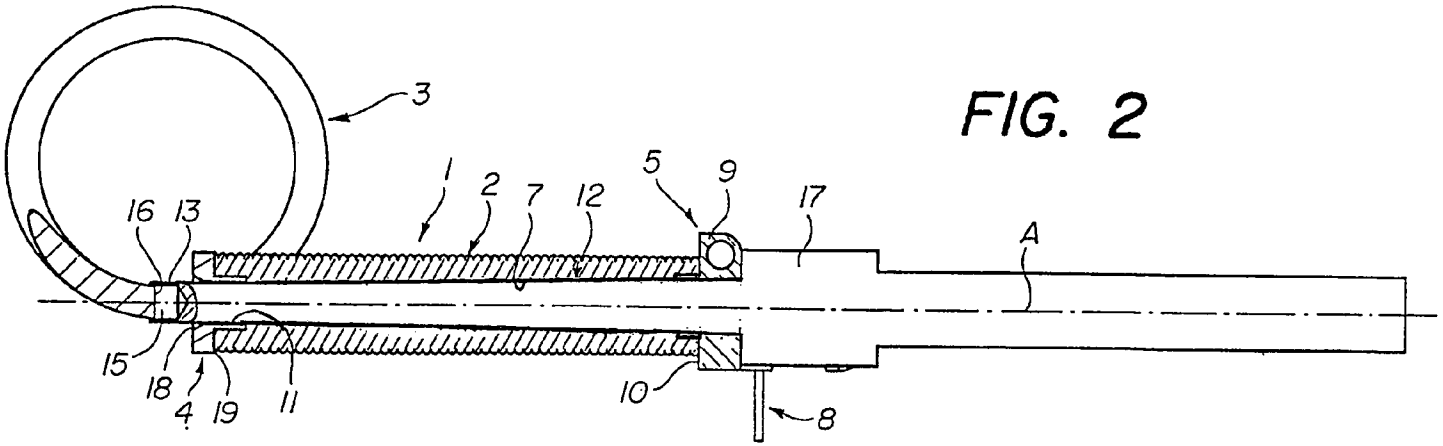
FIG. 2 is a longitudinal section of the assembly shown in FIG. 1.
Figure 7:
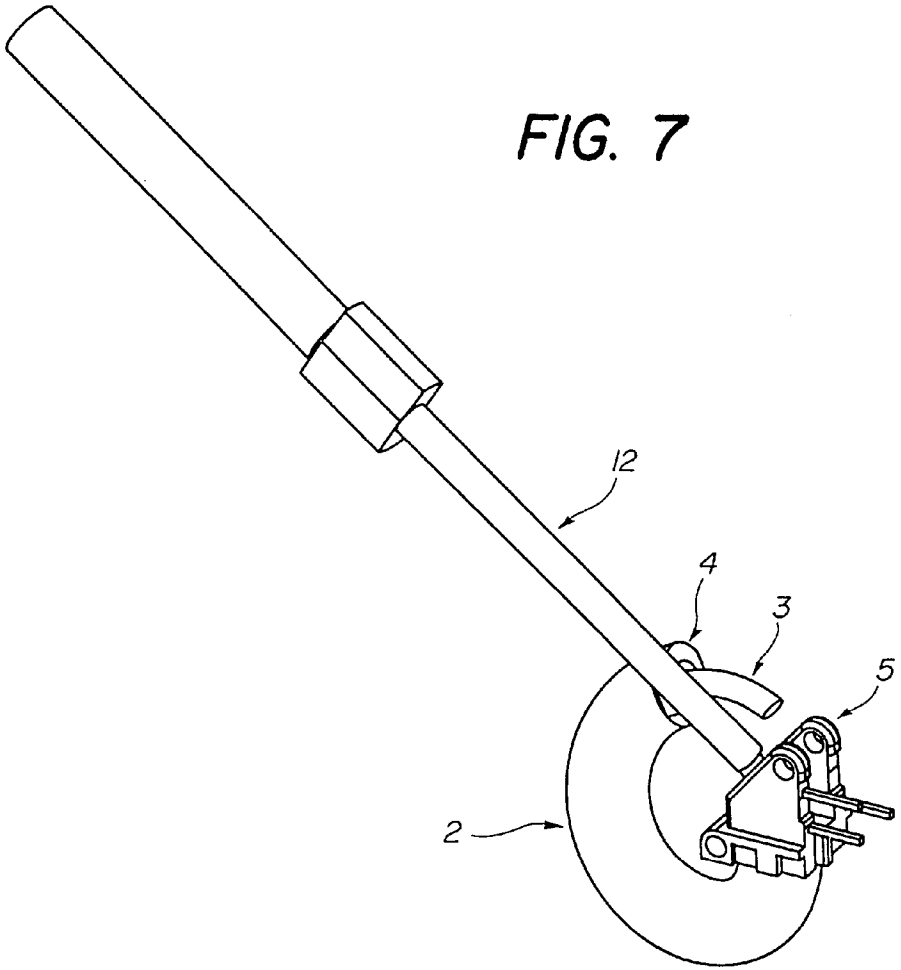

The mandrel comprises a positioning portion 17 to position and block relative rotation of the connector 5 on the mandrel. The mandrel further comprises a cavity 15 at its free end for inserting an end 16 of the magnetic core 3 during the step of insertion of the coil 2 on the core, as shown in FIGS. 1, 2 and 7. After formation of the coil on the mandrel 12, the coil 2 may be easily and directly inserted on the magnetic core 3, as shown in FIG. 7, by actuation of a pushing device 20 engaging the connector end 5 (see FIG. 1). The pushing device may have a fork-shaped portion that may be positioned to straddle the connector behind the flanges 21 thereof after the winding operation. The pushing device moves in the direction (P) parallel to the axis (A) of the mandrel, so as to position the coil 2 precisely on the magnetic core 3. If the coil is made of wire with a thermo-adhesive layer, the coil may be heated or maintained hot to enable deformation thereof during insertion on the core 3.

The tore-shaped core 3 is made of a conventional magnetically permeable material, such as iron-nickel and may have any appropriate shape (cylindrical wire, flattened wire, metal sheet, or an assembly of such elements). Typically, in order to have good magnetic properties, the material is annealed after deformation to an open tore-shape, since large plastic deformation degrades magnetic properties. It is however not possible to anneal the tore once the coil is mounted thereon.

Figure 4:
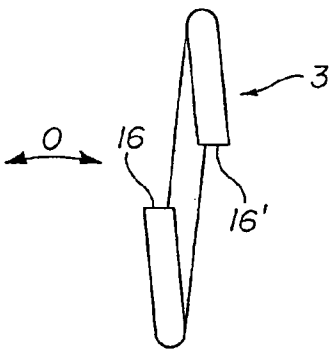
FIG. 4 is a view of a magnetic core cut from the continuous magnetic wire.
Figure 3:
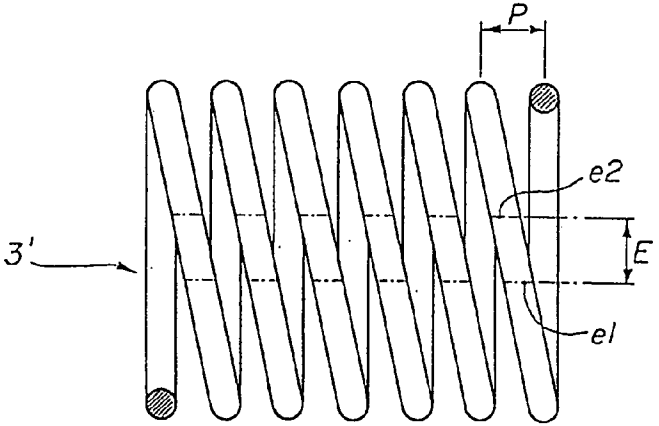
FIG. 3 is a view of a continuous magnetic wire used to form the magnetic core.

In the present invention, plastic deformation of magnetic material is reduced to a minimum in order to reduce the influence of such deformation on the magnetic properties of the core. To this end, the magnetic material has, for example, the shape of a wire 3' provided as a helicoidal spire, as shown in FIG. 3, which is subsequently cut along the dotted lines e1 and e2. A plurality of individual spires may thus be formed, as shown in FIG. 4, the spires being ready for assembly of the coil, as described hereabove, the only plastic deformation of the individual spires being effected after mounting the coil in order to bring the ends 16, 16' of the magnetic core 3 facing each other. The ends 16, 16' are deformed by rotation in a direction substantially orthogonal (O) to the plane of the magnetic circuit and form an air-gap of specified length, depending on the application.

During formation of the helicoidal spire, the pitch (P) may be adjusted to correspond to the necessary separation, in the direction orthogonal (O) to the plane of the circuit, between the ends 16, 16' so as to enable insertion of the coil on the core. The thickness (E) of the longitudinal cut through the spire to form the individual spires may be adjusted so that after rotational deformation of the ends 16, 16' of the magnetic circuit in the substantially orthogonal direction (O), the ends are separated by the specified air-gap length. In this case, the thickness E of the cut is roughly equal to the length of the air-gap.

The magnetic material may thus be annealed after formation of the spire, or after cutting the individual spires, such that the only deformation of the magnetic core after annealing results from bringing the ends 16, 16' of the magnetifc circuit closer together.

I claim:

1. A magnetic circuit (1) comprising an electrical coil (2) and a magnetic core (3), for use as a current sensor, wherein the coil (2) comprises a conducting wire (6), an end plate (4) and a connector (5), the connector comprising a housing and terminals for electrical connection of the electrical coil to an electronic device, the end plate and connector being arranged at respective first and second ends of the coil (2), the coil including the end plate and connector being mounted on the magnetic core (3) formed of a single tore-shaped magnetic wire with air-gap, whereby the coil, end plate and connector comprise a central cavity in which the magnetic core is inserted.

2. The magnetic circuit with coil according to claim 1, wherein an inner cavity (7) of the coil (2) has a slightly conical shape in a direction extending from the first end to the second end of the coil.

3. The magnetic circuit with coil according to claim 2, wherein an angle $\alpha$ of the cone has a value tan $\alpha$ between 0.001 and 0.01.

4. A process for making the magnetic circuit with coil wherein the coil (2) comprises a conducting wire (6), an end plate (4) and a connector (5), the connector comprising a housing and terminals for electrical connection of the electrical coil to an electronic device, the end plate and connector being arranged at respective first and second ends of the coil (2), the coil including the end plate and connector being mounted on the magnetic core (3) formed of a tore-shaped magnetic wire with an air-gap, whereby the coil, end plate and connector comprise a central cavity in which the magnetic core is inserted, comprising the steps of making said coil (2) by winding a conducting wire (6) on a mandrel (12) having first and second ends, the first end being configured in smaller diameter than the second end, such that they form a conical shape in a direction of insertion of the coil on the magnetic core; subsequently inserting the coil (2) on the magnetic core (3), said magnetic core comprising a magnetic material in a form of an open spire having ends (16, 16'), said open spire being formed before providing the magnetic material with specified magnetic properties; and then by deforming the ends (16, 16') of the magnetic core in a substantially orthogonal direction (O) to a plane of the magnetic circuit in order to move said ends closer together.

5. The process according to claim 4, wherein the coil (2) is inserted on the magnetic core (3) during removal of the mandrel (12).

6. The process according to claim 5, wherein one of said ends (16) of the open spire of the magnetic core (3) is inserted in a cavity (15) at a free end (13) of the mandrel (12) in order to facilitate insertion of the coil (2) on the magnetic core (3).

7. The process according to claim 4, wherein, before or during the winding operation, an end plate (4) is placed on the mandrel (12) to form an insertion end (19) of the coil (2), this end being the first to be inserted on the magnetic core (3).

8. The magnetic circuit with coil according to claim 1, wherein the end plate comprises a guide portion (11) around which a portion of the coil is wound.

9. The magnetic circuit with coil according to claim 1, wherein the connector housing comprises a guide portion around which a portion of the coil is wound.

* * * * *